US011739613B2

(12) United States Patent
Mutairi et al.

(10) Patent No.: US 11,739,613 B2
(45) Date of Patent: Aug. 29, 2023

(54) STOPPING FLUID FLOW THROUGH A STUCK OPEN INFLOW CONTROL VALVE

(71) Applicant: Saudi Arabian Oil Company, Dhahran (SA)

(72) Inventors: Khaled M. Mutairi, Riyadh (SA); Mohammed A. Eissa, Safwa (SA); Abdullah M. Haji, Al Umran (SA); Mostafa M. Bori, Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 134 days.

(21) Appl. No.: 17/157,017

(22) Filed: Jan. 25, 2021

(65) Prior Publication Data

US 2022/0235635 A1 Jul. 28, 2022

(51) Int. Cl.

| | |
|---|---|
| ***E21B 34/16*** | (2006.01) |
| ***E21B 47/06*** | (2012.01) |
| ***E21B 47/10*** | (2012.01) |
| ***E21B 34/10*** | (2006.01) |
| ***E21B 47/00*** | (2012.01) |

(52) U.S. Cl.

CPC ..... *E21B 34/16* (2013.01); *E21B 34/102* (2013.01); *E21B 47/00* (2013.01); *E21B 47/06* (2013.01); *E21B 47/10* (2013.01); *E21B 2200/06* (2020.05)

(58) Field of Classification Search

CPC ..... E21B 34/16; E21B 34/102; E21B 47/00; E21B 47/06; E21B 47/10; E21B 2200/06

USPC ..... 166/316

See application file for complete search history.

(56) References Cited

U.S. PATENT DOCUMENTS

| | | | | |
|---|---|---|---|---|
| 6,951,331 | B2 | 10/2005 | Haughom et al. | |
| 7,823,645 | B2 | 11/2010 | Henriksen et al. | |
| 9,376,889 | B2 * | 6/2016 | Reid | E21B 34/10 |
| 9,394,769 | B2 | 7/2016 | Nenniger | |

(Continued)

FOREIGN PATENT DOCUMENTS

| | | | | |
|---|---|---|---|---|
| GB | 2433083 | | 6/2007 | |
| GB | 2433083 | A * | 6/2007 | E21B 34/08 |

(Continued)

OTHER PUBLICATIONS

PCT International Search Report and Written Opinion in International Appln. PCT/US2022/013645, dated May 10, 2022, 14 pages.

(Continued)

*Primary Examiner* — Matthew R Buck
*Assistant Examiner* — Patrick F Lambe
(74) *Attorney, Agent, or Firm* — Fish & Richardson P.C.

(57) ABSTRACT

An assembly and a method for stopping a fluid flow through a stuck open inflow control device are described. An inflow control valve includes a valve body with an inlet, an inner sleeve, and an outer sleeve, and an actuation mechanism. The inner sleeve is movably coupled to an inner surface of the valve body to control fluid flow through the valve body. The outer sleeve is coupled to an outer surface of the valve body to stop the fluid flow through the inlet when the inner sleeve is stuck open. The outer sleeve is movable from a position allowing fluid flow through the valve body to a locked position stopping fluid flow through the valve body. The actuation mechanism moves the outer sleeve from the position offset from the inlet to the locked position.

19 Claims, 4 Drawing Sheets

(56) References Cited

U.S. PATENT DOCUMENTS

| | | | | |
|---|---|---|---|---|
| 9,926,766 | B2 * | 3/2018 | Xu | E21B 23/01 |
| 10,502,024 | B2 * | 12/2019 | Wang | E21B 34/10 |
| 2015/0021015 | A1 | 1/2015 | Xiao | |

FOREIGN PATENT DOCUMENTS

| | | |
|---|---|---|
| GB | 2522272 | 7/2015 |
| WO | WO 2011072367 | 6/2011 |

OTHER PUBLICATIONS

Arukhe et al., "Smart Well Completion Optimization in Multilateral Wells." Abu Dhabi International Petroleum Exhibition & Conference. OnePetro, Nov. 2017, 10 pages.

Barreto et al., "Evaluation of Different Types of Operation for Inflow-Control-Valves based on Production and Reservoir Data." SPE Latin America and Caribbean Petroleum Engineering Conference. Society of Petroleum Engineers, May 2014, 18 pages.

Halliburton.com [online], "Single-Trip Multizone Cased-Hole Frac Packs and Intelligent Completions Improve Recovery in Subsea Gas Field", available on or before Feb. 2020, via Internet Archive: Wayback Machine URL <http://web.archive.org/web/20200229160431/https://www.halliburton.com/content/dam/ps/public/cps/contents/Case_Histories/web/h013056-estmz-ic.pdf>, retrieved on Apr. 6, 2021, URL <https://www.halliburton.com/content/dam/ps/public/cps/contents/Case_Histories/web/h013056-estmz-ic.pdf?nav=en-US_well-dynamics_public>, 2 pages.

SLB.com [online], "Downhole Interval Control Valves (ICVS)" Aug. 2019, [retrieved on Apr. 6, 2021], retrieved from: URL <https://www.slb.com/completions/well-completions/intelligent-completions/downhole-interval-control-valves>, 8 pages.

Zarea et al., "An integrated performance model for multilateral wells equipped with inflow control valves." SPE EUROPEC/EAGE Annual Conference and Exhibition. Society of Petroleum Engineers, Jan. 2011, 17 pages.

* cited by examiner

STOPPING FLUID FLOW THROUGH A STUCK OPEN INFLOW CONTROL VALVE

TECHNICAL FIELD

This disclosure relates to stopping flow through stuck open valves.

BACKGROUND OF THE DISCLOSURE

In oil and gas production operations, fluids and gases containing hydrocarbons, along with water and other chemicals, flow from formations of the earth into a wellbore drilled from a surface of the earth to the formations beneath the surface of the earth. The fluids and gases flow uphole from the formations through the wellbore to the surface of the earth. A completion is the equipment placed in a wellbore after the wellbore has been drilled in the earth by a drilling rig. The completion is used to extract naturally occurring hydrocarbon deposits from the earth and move the hydrocarbons and water to the surface of the earth. Completion equipment may be placed in an open wellbore or in a cased wellbore. An open wellbore is a wellbore that is in direct contact with the earth and various subsurface formations of the earth. A cased wellbore is a wellbore that has been sealed from the earth and various subsurface formations of the earth. A wellbore can be fully cased or have portions that are open. Completing a wellbore is the process of disposing or placing the completion equipment within the wellbore. One type of completion equipment positioned in wellbores are inflow control valves.

SUMMARY

A wellbore is drilled from the surface of the earth to geologic formations of the earth containing liquids and gases, in the form of hydrocarbons, chemicals, and water. An inflow control valve can be positioned in a flow path of the wellbore from a single geologic formation to the wellbore to control the flow of the liquids and gases from that single geologic formation into the wellbore. Multiple inflow control valves can be installed in a single wellbore to control different fluid and gas flows from different geologic formations through which the wellbore passes. Inflow control valves can become stuck open allowing fluid flow into the wellbore. The present disclosure relates to stopping flow through a stuck open inflow control valve.

An inflow control valve of the present disclosure has a valve body with an inlet. The inflow control valve has an inner sleeve that is coupled to an inner surface of the valve body. The inner sleeve moves from a closed position to an open position to provide a fluid flow path from an annulus of a wellbore through the valve body. The inner sleeve also moves from the open position to the closed position to restrict the fluid flow through the valve body. The inflow control valve has an outer sleeve coupled to an outer surface of the valve body to stop the fluid flow through the inlet. The outer sleeve moves from a normal operating position offset from the inlet of the inflow control valve body to a locked position limiting fluid flow to the inlet of the inflow control valve to stop the fluid flow through the inflow control valve. The inflow control valve has a first actuation mechanism coupled to the outer sleeve. The first actuation mechanism operates to move the outer sleeve from the normal operating position offset from the inlet of the inflow control valve body to the locked position to stop the fluid flow through the inflow control valve body. The inner sleeve can become stuck open, allowing fluid flow through the inlet. When the inner sleeve becomes stuck open, the outer sleeve can be shut by actuating the first actuation mechanism to stop fluid flow through the inlet.

Implementations of the present disclosure include an assembly and a method for stopping fluid flow through a stuck open inflow control valve. A wellbore inflow control valve includes an inflow control valve body, an inner sleeve, an outer sleeve, and a first actuation mechanism. The inflow control valve body includes an inlet. The inner sleeve is coupled to an inner surface of the inflow control valve body.

The inner sleeve is movable from a closed position to an open position to provide a fluid flow path from an annulus of a wellbore through the inflow control valve body and moveable from the open position to the closed position to restrict the fluid flow through the inflow control valve body. Where the inflow control valve further includes inner sleeve coupled to the inner surface of the inflow control valve body, the inner sleeve can slide relative to the inner surface of the inflow control valve body stopping a fluid flow through the inflow control valve.

The outer sleeve is coupled to an outer surface of the inflow control valve body to stop the fluid flow through the inlet. The outer sleeve is movable from a normal operating position offset from the inlet of the inflow control valve body to a locked position limiting fluid flow to the inlet of the inflow control valve to stop the fluid flow through the inflow control valve. The outer sleeve can further include a sleeve sliding cap coupled to the outer sleeve. The outer sleeve can further include a latch to maintain the outer sleeve in the locked position.

The first actuation mechanism is coupled to the outer sleeve. The actuation mechanism is operable to move the outer sleeve from the normal operating position offset from the inlet of the inflow control valve body to the locked position limiting fluid flow to the inlet of the inflow control valve body to stop the fluid flow through the inflow control valve body. The first actuation mechanism can include a nitrogen pressure vessel.

In some implementations, the wellbore inflow control valve further includes a second actuation mechanism coupled to the inner sleeve. The second actuation mechanism is operable to reversibly move the inner sleeve between the closed position and the open position to control fluid flow through the inflow control valve body.

In some implementations, the wellbore inflow control valve of claim 1 includes a sensor and a controller. The sensor senses a wellbore condition of the wellbore and generate a signal representing the wellbore condition. The sensor can be at least one of a pressure sensor, a conductivity sensor, or a flow rate sensor. The controller receives the signal representing the wellbore condition, and responsive to receiving the signal representing the wellbore condition, to operate the first actuation mechanism to move the outer sleeve to the locked position to stop the fluid flow through the inflow control valve body.

Further implementations of the present disclosure include a valve assembly. The valve assembly includes a sliding element and first actuation mechanism. The sliding element includes an outer sleeve. The outer sleeve is positioned external to a valve body defining an inlet. The outer sleeve is movable from a normal operating position offset from the inlet of the valve body to a locked position limiting fluid flow to the inlet of the valve body to stop the fluid flow through the valve body. The sliding element can further include a sleeve sliding cap. The sliding element can also further include a latch to maintain the outer sleeve in the locked position.

The first actuation mechanism is coupled to the outer sleeve. The first actuation mechanism is operable to move the outer sleeve from the normal operating position offset from the inlet of the valve body to the locked position limiting fluid flow to the inlet of the valve body to stop the fluid flow through the valve body. The first actuation mechanism can include a nitrogen pressure vessel.

In some implementations, the valve assembly includes a sensor and a controller. The sensor senses a condition and generate a signal representing the condition. The sensor can include at least one of a pressure sensor, a conductivity sensor, a flow rate sensor, or a valve position sensor. The controller receives the signal representing the condition, and responsive to receiving the signal representing the condition, positions the actuation mechanism to position the outer sleeve to stop the fluid flow through the valve body.

In some implementations, the valve assembly further includes an inner sleeve coupled to an inner surface of the valve body. The inner sleeve is movable from a closed position to an open position to provide a fluid flow path through the valve body and moveable from the open position to the closed to restrict the fluid flow path through the valve body.

In some implementations, the valve assembly further includes a second actuation mechanism coupled to the inner sleeve. The second actuation mechanism is operable to reversibly move the inner sleeve between the closed position and the open position to control fluid flow through the valve body.

Further implementations of the present disclosure include a method of stopping a fluid flow of a wellbore. The wellbore includes a wellbore inflow control valve to control the fluid flow through the wellbore. The wellbore inflow control valve includes an inflow control valve body, an inner sleeve, an outer sleeve, and a first actuation mechanism. The inflow control valve body includes an inlet. The inner sleeve is coupled to an inner surface of the inflow control valve body. The inner sleeve is movable from a closed position to an open position to provide a fluid flow path from an annulus of a wellbore through the inflow control valve body and moveable from the open position to the closed position to restrict the fluid flow through the inflow control valve body. The outer sleeve is coupled to an outer surface of the inflow control valve body to stop the fluid flow through the inlet. The outer sleeve is movable from a normal operating position offset from the inlet of the inflow control valve body to a locked position limiting fluid flow to the inlet of the inflow control valve to stop the fluid flow through the inflow control valve. The first actuation mechanism is coupled to the outer sleeve. The first actuation mechanism is operable to move the outer sleeve from the normal operating position offset from the inlet of the inflow control valve body to the locked position limiting fluid flow to the inlet of the inflow control valve body to stop the fluid flow through the inflow control valve body.

The method of stopping a fluid flow of a wellbore includes actuating the first actuation mechanism. Where the wellbore inflow control valve further includes a sensor to sense a wellbore condition of the wellbore and generate a signal representing the wellbore condition and a controller to receive the signal representing the wellbore condition, and responsive to receiving the signal representing the wellbore condition, to operate the first actuation mechanism to move the outer sleeve from the normal operating position to the locked position to limit fluid flow through the inflow control valve, actuating the first actuation mechanism can further include sensing the wellbore condition. Where wellbore condition indicates the inner sleeve failed to shut, allowing fluid flow through the inlet, the sensor can generate a signal representing the wellbore condition indicating the inner sleeve failed to shut and transmit the signal representing the wellbore condition indicating the inner sleeve failed to shut to the controller. The signal representing the wellbore condition indicating the inner sleeve failed to shut can be received at the controller. Responsive to receiving the signal representing the wellbore condition indicating the inner sleeve failed to shut, by the controller, the first actuation mechanism can be actuated.

Where the first actuation mechanism includes a nitrogen pressure vessel, actuating the first actuation mechanism can further include by the controller, flowing a pressurized nitrogen gas from the nitrogen pressure vessel to the outer sleeve. Responsive to flowing the pressurized nitrogen gas from the nitrogen pressure vessel to the outer sleeve, the outer sleeve can be moved from the normal operating position to the locked position, stopping the fluid flow.

The method of stopping a fluid flow of a wellbore includes, responsive to actuating the first actuation mechanism, moving the outer sleeve from the normal operating position to the locked position.

The method of stopping a fluid flow of a wellbore includes, responsive to moving the outer sleeve from the normal operating position to the locked position, stopping the fluid flow.

In some implementations, where the wellbore inflow control valve further includes a latch, the method of stopping a fluid flow of a wellbore can include latching the outer sleeve in the locked position. Responsive to latching the outer sleeve in the locked position, the fluid flow is maintained stopped.

In some implementations, when the outer sleeve is in the locked position, the method can include unlatching the outer sleeve. The method can include releasing, by the controller, the pressurized nitrogen gas from the outer sleeve. Responsive to releasing the pressurized nitrogen gas from the outer sleeve, moving the outer sleeve from the locked position to the normal operating position. Responsive to moving the outer sleeve from the locked position to the normal operating position, allowing the fluid flow.

Implementations of the present disclosure can realize one or more of the following advantages. Sealing a wellbore tubular flow from a stuck open valve can be simplified and accomplished quickly. In some cases, a single lateral of a multiple lateral wellbore containing a stuck open inflow control valve can be isolated, while maintaining the other producing lateral wellbores open to flow, without isolating the entire wellbore. This can avoid unnecessary producing well downtime by sustaining production from other producing formations and zones. In some instances, if an inflow control valve is stuck open, use of a workover rig is required to stop the flow through the wellbore. This can be a time intensive and costly operation. By implementing techniques described in this specification, such complex removal and replacement operations can be avoided. Additionally, a high water volume producing formation adjacent to a stuck open inflow control valve can be isolated. This can extend the run-life of a well by increasing the overall value of the produced liquids and gases, keeping a wellbore economically viable to produce.

Other aspects and advantages of this disclosure will be apparent from the following description made with reference to the accompanying drawings and the claims.

BRIEF DESCRIPTION OF DRAWINGS

Like reference numbers and designations in the various drawings indicate like elements.

DETAILED DESCRIPTION

The present disclosure relates to an assembly and a method for stopping fluid flow through a stuck open inflow control valve of wellbore. Multiple inflow control valves can be installed in a wellbore drilled from the surface of the earth to geologic formations of the earth containing liquids and gases, in the form of hydrocarbons, chemicals, and water. Completion equipment can be placed in the wellbore to conduct and control the flow of the liquids and gases through the wellbore from the geologic formations to the surface of the earth. An inflow control valve is one type of completion equipment that can be positioned in a flow path from a single geologic formation to the wellbore to control the flow of the liquids and gases from that single geologic formation into the wellbore. Multiple inflow control valves can be installed in a single wellbore to control different fluid and gas flows from different geologic formations or selected zones from the same formation through which the wellbore passes. The different geologic formations or zones can be isolated from the others by isolation devices such as packers.

Inflow control valves can become stuck open. For example, geologic debris such as rocks or sand from the associated geologic formation can mechanically block the inflow control valve from shutting. Additionally or alternatively, chemicals from the geologic formation can corrode the inflow control valve, rendering the inflow control valve inoperable, preventing the inflow control valve from shutting. In such instances, fluid and gas flow from the formation continues into the wellbore.

An inflow control valve including a valve body, an inner sleeve, an outer sleeve, and a first actuation mechanism can be installed in a wellbore to stop fluid flow through a stuck open inner sleeve of the inflow control valve by shutting the outer sleeve. The valve body includes an inlet. The inner sleeve is coupled to an inner surface of the valve body. The inner sleeve is movable from a closed position to an open position to provide a fluid flow path from an annulus of a wellbore through the valve body and moveable from the open position to the closed position to restrict the fluid flow through the valve body. The outer sleeve is coupled to an outer surface of the valve body to stop the fluid flow through the inlet. The outer sleeve is movable from a normal operating position offset from the inlet of the valve body to a locked position limiting fluid flow to the inlet of the valve body to stop the fluid flow through the inflow control valve. The first actuation mechanism is coupled to the outer sleeve. The actuation mechanism is operable to move the outer sleeve from the normal operating position offset from the inlet of the valve body to the locked position limiting fluid flow to the inlet of the valve body to stop the fluid flow through the valve body.

Figure 1A:
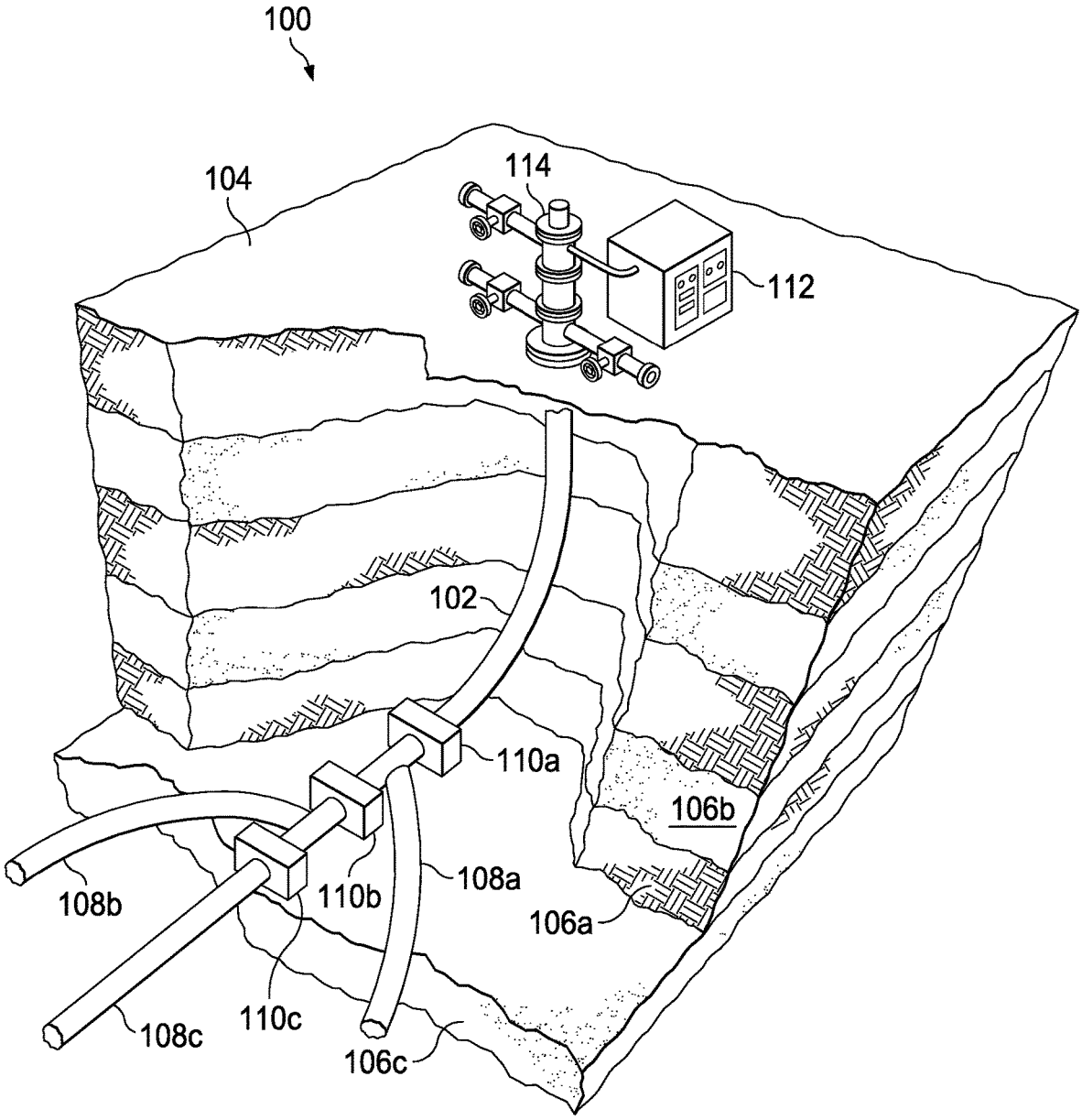
FIG. 1A is a schematic view of a wellbore with multiple inflow control valves positioned in the wellbore.

FIG. 1A is a schematic view of a wellbore with multiple inflow control valves positioned in the wellbore. A wellbore fluid control system 100 is shown in FIG. 1A. The wellbore fluid control system 100 includes a wellbore 102 extending from a surface 104 of the earth down through multiple geologic formations of the earth. Some geologic formations, for example a first formation 106*a*, can contain hydrocarbons, water, and chemicals in the form of liquids and gases. The first formation 106*a* is bounded by a second formation 106*b* and a third formation 106*c*. The second formation 106*b* and the third formation 106*c* can also contain hydrocarbons, water, and chemicals in the form of liquids and gases. When the second formation 106*b* and a third formation 106*c* contain hydrocarbons, water, and chemicals in the form of liquids and gases, the second formation 106*b* and a third formation 106*c* can include completion devices such as the inflow control devices described in this specification.

In some cases, multiple branches of wellbores can be drilled from the wellbore 102. Each branch can also be referred to as a lateral. The entire wellbore can be referred to as a multi-lateral well. The wellbore 102 has three branches, a first branch 108*a*, a second branch 108*b*, and a third branch 108*c*, to conduct fluids from different locations in the first formation 106*a* into the wellbore and up to the surface 104 of the earth. In some cases, where the second formation 106*b* and the third formation 106*c* contain hydrocarbons, water, and chemicals in the form of liquids and gases, the second branch 108*b* can be positioned in the second formation 106*b*, and the third branch 108*c* can be positioned in the third formation 106*c*. In some cases, the wellbore 102 can include few or more than three branches. In some cases, multiple branches can be drilled in a single formation.

A first inflow control device 110*a* is installed in the wellbore 102 to control the fluid flow from the first branch 108*a*. A second inflow control device 110*b* is installed in the wellbore 102 to control the fluid flow from the second branch 108*b*. A third inflow control device 110*c* is installed in the wellbore 102 to control the fluid flow from the third branch 108*c*.

The wellbore fluid control system 100 includes a control panel 112 to operate the first inflow control device 110*a*, the second inflow control device 110*b*, and the third inflow control device 110*c*. The control panel 112 can be at or near the wellhead 114 or can be remotely controlled by remote operations center (not shown).

Figure 1B:
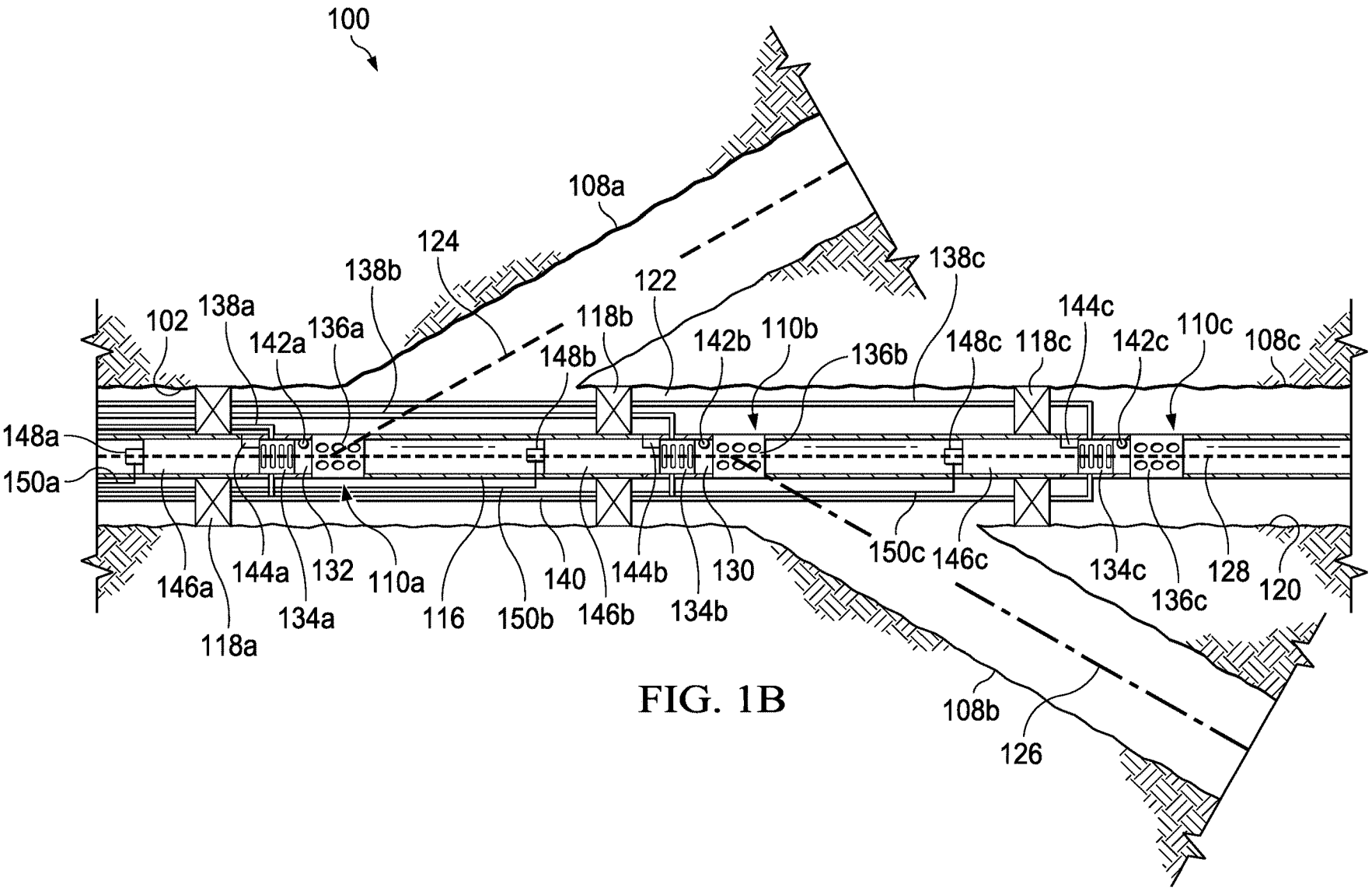
FIG. 1B is a schematic view of a portion of the wellbore of FIG. 1A.

FIG. 1B is a schematic view of a portion of the wellbore of FIG. 1A. FIG. 1B shows a detailed view of the first inflow control device 110*a*, the second inflow control device 110*b*, and the third inflow control device 110*c* positioned into the first branch 108*a*, the second branch 108*b*, and the third branch 108*c*, respectively, of the wellbore 102. The first inflow control device 110*a*, the second inflow control device 110*b*, and the third inflow control device 110*c* are coupled to a tubular 116 positioned in the wellbore 102. The tubular 116 conducts the liquids and gases from the first branch 108*a*, the second branch 108*b*, and the third branch 108*c* to the surface 104. The tubular 116 can be a production tubular. The tubular 116 can be made of a metal, for example, steel.

A first packer 118*a* surrounds the tubular 116 and is engaged to an inner surface 120 of the wellbore 102 to fluidically seal the fluid in the first branch 108*a* from a wellbore annulus 122. The fluid flow path follows first flow path 124 into the first inflow control device 110*a* into the tubular 116 and then up the surface 104 of the earth (shown in FIG. 1A). The first branch 108*a* is fluidically isolated from the second branch 108*b* by a second packer 118*b*. The second packer 118*b* surrounds the tubular 116 and is engaged to an inner surface 120 of the wellbore 102 to fluidically seal the fluid in the second branch 108*b* from the first branch 108*a*. The fluid flow path follows a second flow path 126 into the second inflow control device 110*b* into the tubular 116 and then up the surface 104 of the earth (shown in FIG. 1A). The third branch 108*c* is fluidically isolated from the second branch 108*b* by a third packer 118*c*. The third packer 118*c* surrounds the tubular 116 and is engaged to an inner surface 120 of the wellbore 102 to fluidically seal the fluid in the third branch 108*c* from the second branch 108*b*. The fluid flow path follows a third flow path 128 into the third inflow control device 110*c* into the tubular 116 and then up the surface 104 of the earth (shown in FIG. 1A).

The fluids and gases from the third branch 108*c* flow into the third inflow control valve 110*c* and into the tubular 116 in the direction shown by arrows 128. The fluids and gases from the second branch 108*b* flow into the second inflow control device 110*b*. The fluids and gases from the third branch 108*c* and the second branch 108*b* mix and combine in the tubular 116 at location 130 and continue flowing towards the surface 104 (which can also be referred to as an uphole direction). The fluids and gases from the first branch 108*a* mix and combine with the fluids and gases from the third branch 108*c* and the second branch 108*b* in the tubular 116 at location 132 and continue flowing towards the surface 104.

Figure 2A:
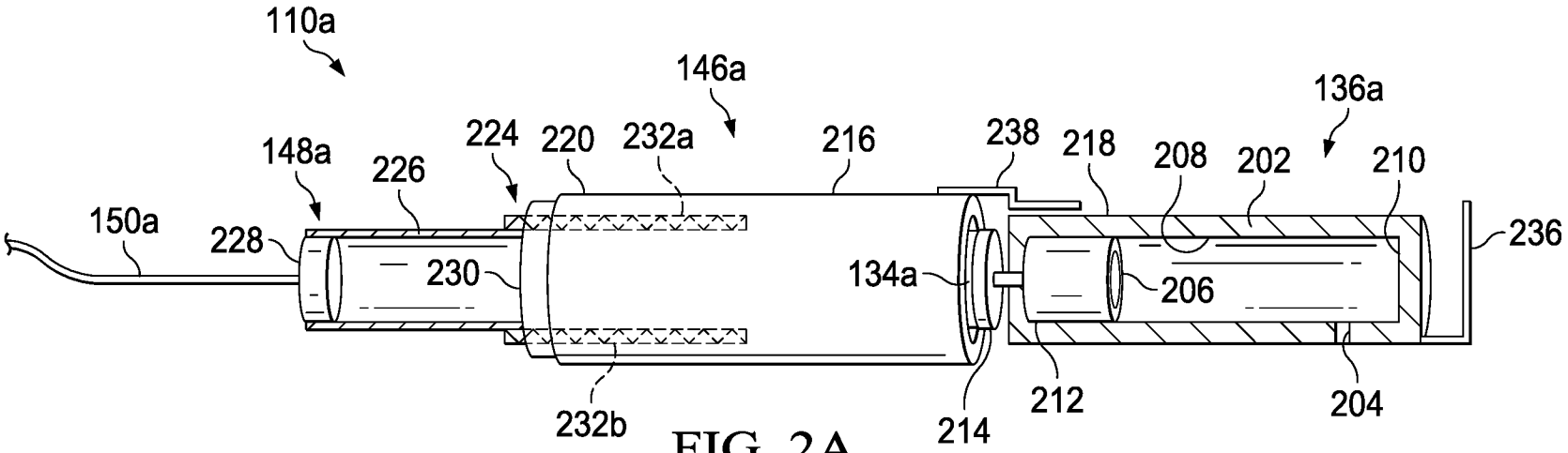
FIG. 2A is a schematic view of an inflow control valve with the outer sleeve in an normal operating position.
Figure 2B:
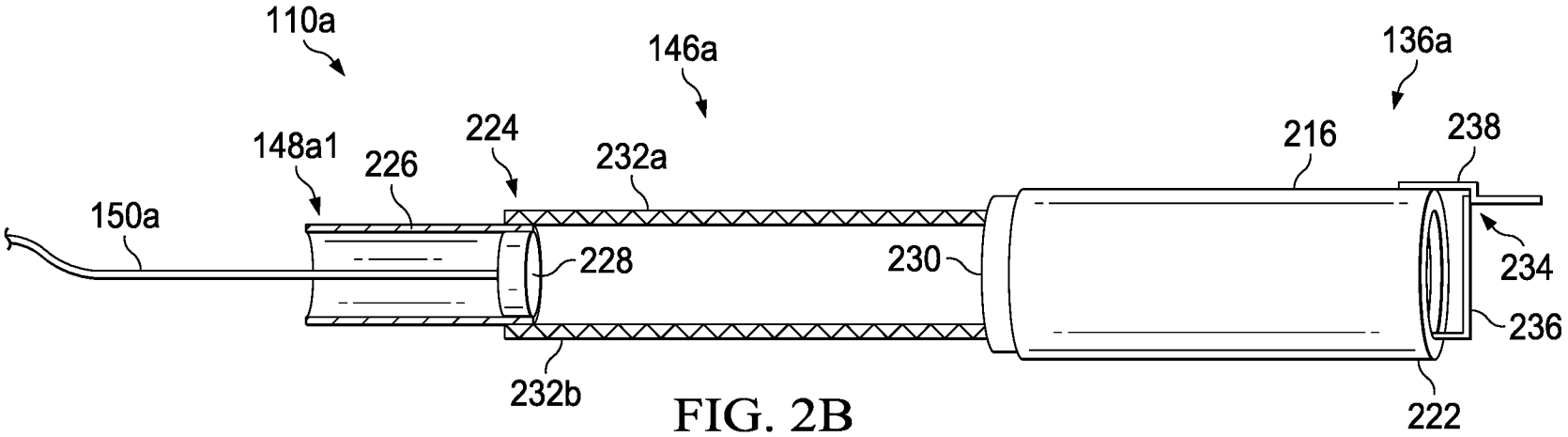
FIG. 2B is a schematic view of the inflow control valve of FIG. 2B with the outer sleeve in a locked position.

The first wellbore inflow control device 110*a* includes a first control unit 134*a* to actuate a first inflow control valve 136*a*, both described with respect to FIGS. 2A-2B. The control panel 112 (shown in FIG. 1A) controls the flow of hydraulic fluid in a first hydraulic supply conduit 138*a* to the first control unit 134*a*. A common hydraulic return conduit 140 flows the hydraulic fluid back to the control panel 112. Flowing the hydraulic fluid to the first control unit 134*a* actuates the first control unit 134*a* to operate the first inflow control valve 136*a*.

The second wellbore inflow control device 110*b* includes a second control unit 134*b* to actuate a second inflow control valve 136*b*. The control panel 112 (shown in FIG. 1A) controls the flow of hydraulic fluid in a second hydraulic supply conduit 138*b* to the second control unit 134*b*. The common hydraulic return conduit 140 flows the hydraulic fluid back to the control panel 112. Flowing the hydraulic fluid to the second control unit 134*b* actuates the second control unit 134*b* to operate the second inflow control valve 136*b*.

The third wellbore inflow control device 110*c* includes a third control unit 134*c* to actuate a third inflow control valve 136*c*. The control panel 112 (shown in FIG. 1A) controls the flow of hydraulic fluid in a third hydraulic supply conduit 138*c* to the third control unit 134*c*. The common hydraulic return conduit 140 flows the hydraulic fluid back to the control panel 112. Flowing the hydraulic fluid to the third control unit 134*c* actuates the third control unit 134*c* to operate the third inflow control valve 136*c*.

The first wellbore inflow control device 110*a* includes a first outer sleeve assembly 146*a* and a first outer sleeve actuation mechanism 148*a*. The first outer sleeve assembly 146*a* moves laterally over the first control unit 134*a* and the first inflow control valve 136*a* to seal the first inflow control valve 136*a*. The first outer sleeve assembly 146*a* seals a fluid flow in to or out of the first inflow control valve 136*a*. The first outer sleeve actuation mechanism 148*a* actuates the first outer sleeve 146*a*. The first outer sleeve actuation mechanism 148*a* includes a first hydraulic control conduit 150*a* coupled to the control panel 112. The control panel 112 controls a supply of hydraulic fluid to the first outer sleeve actuation mechanism 148*a* to actuate the first outer sleeve actuation mechanism 148*a*, moving the first outer sleeve assembly 146*a* to stop fluid flow through the first inflow control valve 136*a*. The first hydraulic control conduit 150*a* can include a hydraulic return line (not shown). The first outer sleeve assembly 146*a* and the first outer sleeve actuation mechanism 148*a* are described in more detail referring to FIGS. 2A and 2B.

The second wellbore inflow control device 110*b* includes a second outer sleeve assembly 146*b* and a second outer sleeve actuation mechanism 148*b*. The second outer sleeve assembly 146*b* moves laterally over the second control unit 134*b* and the second inflow control valve 136*b* to seal the second inflow control valve 136*b*. The second outer sleeve assembly 146*b* seals a fluid flow in to or out of the second inflow control valve 136*b*. The second outer sleeve actuation mechanism 148*b* actuates the second outer sleeve assembly 146*b*. The second outer sleeve actuation mechanism 148*b* includes a second hydraulic control conduit 150*b* coupled to the control panel 112. The control panel 112 controls a supply of hydraulic fluid to the second outer sleeve actuation mechanism 148*b* to actuate the second outer sleeve actuation mechanism 148*b*, moving the second outer sleeve assembly 146*b* to stop fluid flow through the second inflow control valve 136*b*. The second hydraulic control conduit 150*b* can include a hydraulic return line (not shown). The second outer sleeve assembly 146*b* and the second outer sleeve actuation mechanism 148*b* are described in more detail referring to FIGS. 2A and 2B.

The third wellbore inflow control device 110*c* includes a third outer sleeve assembly 146*c* and a third outer sleeve actuation mechanism 148*c*. The third outer sleeve assembly 146*c* moves laterally over the third control unit 134*c* and the third inflow control valve 136*c* to seal the third inflow control valve 136*c*. The third outer sleeve assembly 146*c* seals a fluid flow in to or out of the third inflow control valve 136*c*. The third outer sleeve actuation mechanism 148*c* actuates the third outer sleeve assembly 146*c*. The third outer sleeve actuation mechanism 148*c* includes a third hydraulic control conduit 150*c* coupled to the control panel 112. The control panel 112 controls a supply of hydraulic fluid to the third outer sleeve actuation mechanism 148*c* to actuate the third outer sleeve actuation mechanism 148*c*, moving the third outer sleeve assembly 146*c* to stop fluid flow through the third inflow control valve 136*c*. The third hydraulic control conduit 150*c* can include a hydraulic return line (not shown). The third outer sleeve assembly 146*c* and the third outer sleeve actuation mechanism 148*c* are described in more detail referring to FIGS. 2A and 2B.

FIG. 2A is a schematic view of a wellbore inflow control valve with the outer sleeve in a normal operating position offset from the inlet of the inflow control valve body allowing the fluid flow through the inflow control valve. The first inflow control valve 136*a* includes a valve body 202. The valve body 202 is a hollow cylindrical body which includes an inlet 204. The inlet 204 can be a single inlet or multiple inlets. Fluids and gases from the first branch 108*a* of the wellbore 102 flow into the valve body 202 through the inlet 204. The valve body 202 can be made of a metal, for example, steel or aluminum.

The first inflow control valve 136*a* includes an inner sleeve 206. The inner sleeve 206 is positioned within the valve body 202. The inner sleeve 206 is coupled to an inner surface 208 of the valve body 202. The inner sleeve 206 moves from a closed position 210 to an open position 212 (as shown in FIG. 2A) to provide a fluid flow path from the wellbore annulus 122 (shown in FIG. 1B) through the valve body 202. The inner sleeve 206 also moves from the open position 212 to the closed position 210 to restrict the fluid flow through the valve body 202. The inner sleeve 206 can be made from a metal, for example, steel or aluminum.

The first inflow control valve 136*a* includes an inner sleeve actuation mechanism 214 coupled to the inner sleeve 206. The inner sleeve actuation mechanism 214 operates to reversibly move the inner sleeve 206 between the closed position 210 and the open position 212 to control fluid flow through the valve body 202. The inner sleeve actuation mechanism 214 can be a hydraulic control valve. The inner sleeve actuation mechanism 214 is operated by the control panel 112 to supply hydraulic fluid through the first hydraulic supply conduit 138*a* and the common hydraulic return conduit 140 as previously described in reference to FIG. 1B, to move the inner sleeve 206 between the closed position 210 and the open position 212.

FIG. 2B is a schematic view of the inflow control valve of FIG. 1A with the outer sleeve in a locked position sealing the inlet of the inflow control valve to stop the fluid flow through the inflow control valve. The outer sleeve 216 is coupled to an outer surface 218 of the valve body 202 to stop the fluid flow through the inlet 204, the outer sleeve 216 moves from a normal operating position 220 offset from the inlet 204 of the valve body 202 to a locked position 222, shown in FIG. 2B, stopping fluid flow to the inlet 204 of the inflow control valve body 202. The outer sleeve 216 is a metal, for example, steel or aluminum.

The first hydraulic control conduit 150*a* supplies hydraulic fluid to the first outer sleeve actuation mechanism 148*a* to move the outer sleeve 216 from the normal operating position 220 offset from the inlet 204 of the valve body 202 to the locked position 222 stopping fluid flow to the inlet 204. The first outer sleeve actuation mechanism 148*a* is coupled to the outer sleeve 216. The first outer sleeve actuation mechanism 148*a* operates to move the outer sleeve 216 from the normal operating position 220 offset from the inlet 204 of the valve body 202 allowing fluid flow, to the locked position 222 limiting fluid flow to the inlet 204 of the valve body 202 stopping the fluid flow through the valve body 202.

As shown in FIG. 2A, the first outer sleeve actuation mechanism 148*a* includes a pressure vessel 226. The pressure vessel 226 contains a pressurized gas, such as nitrogen, to provide a motive force to the outer sleeve 216 to move the outer sleeve 216 from the normal operating position 220 to the locked position 222. The pressure vessel 226 includes a piston 228 to further force the pressurized nitrogen to move the outer sleeve 216. Additionally or alternatively, the piston 228 maintains the nitrogen pressurized within the pressure vessel 226. The piston 228, when actuated by the hydraulic fluid in the first hydraulic supply conduit 150*a*, forces a sliding sleeve cap 230 coupled to the outer sleeve 216 to move the outer sleeve 216 from the normal operating position 220 to the locked position 222.

The sliding sleeve cap 230 is movably coupled to a sliding element 232*a*. The sliding element 232*a* is coupled to the outer sleeve 216 to align and move the outer sleeve 216 to seal the inlet 204. The sliding element 232*a* provides a pathway for the sliding cap to ride in or on as it moves the outer sleeve 216. The sliding element 232*a* can be a channel, a portion of a rack and pinion gear, or a metallic sliding element/path guide. The first outer sleeve assembly 146*a* can include multiple sliding elements. For example, as shown in FIGS. 2A and 2B, the outer sleeve 216 can include a second sliding element 232*b* substantially similar to the first sliding element 232*a* described previously. In some cases, the sliding element 232*a* can be an assembly of a tube and a spring with a guide rod.

The outer sleeve 216 can include a mechanism to lock the outer sleeve 216 in its closed position. For example, the outer sleeve 216 can include a latch mechanism 234. The latch mechanism includes a lever 236 and a latch 238. The latch 238 is mechanically coupled to the outer sleeve 216. As the outer sleeve 216 moves to seal the inlet 204, the latch 238 slides over the lever 236 and catches on the lever 236, locking the outer sleeve 216 in place at the locked position 222, sealing the inlet 204. The latch mechanism 234, when the latch 238 is engaged to the lever 236, keeps outer sleeve 216 fixed at the locked position 222 eliminating reverse movement of the outer sleeve 216 after sealing the inlet 204 with the outer sleeve 216.

Referring to FIG. 1B, the first wellbore inflow control device 110*a* includes a first sensor 142*a*. The first sensor 142*a* senses a wellbore condition of the wellbore 102 and generates a signal representing the wellbore condition. The first sensor 142*a* transmits the signal representing the wellbore condition to a first controller 144*a*. The first controller 144*a* receives the signal representing the wellbore condition and compares the signal representing the wellbore condition to an expected value. When the result of the comparison indicates that the inflow control valve 136*a* is stuck open, the first controller 144*a* operates the first control unit 134*a* to move the outer sleeve 216 to the locked position 222 to stop the fluid flow through the inlet 204. Some examples of wellbore conditions which can be sensed include pressure, conductivity, flow rate, or inner sleeve position. The sensor 142*a* can be a pressure sensor, a conductivity sensor, a flow rate sensor, or a position sensor. Alternatively or in addition, when the result of the comparison indicates that the inflow control valve 136*a* is stuck open, the first controller 144*a* can send a signal to the control panel 112 to alert an operator to a stuck open inflow control valve 136*a* condition. The operator can use the data collected from the first sensor 142*a* data to actuate the system manually.

The controller 144*a* can have one or more set of programmed instructions stored in a memory or other non-transitory computer-readable media that stores data (e.g., connected with the printed circuit board), which can be accessed and processed by a microprocessor. The programmed instructions can include, for example, instructions for sending or receiving signals and commands to operate the first control unit 134*a* and instructions for collecting and storing data from the first sensor 142*a*. The data also can be transmitted to the surface panel 112 to be used to verify the condition of the valve.

The second wellbore inflow control device 110*b* includes the second control unit 134*b*, substantially similar to the first control unit 134*a* previously described. The second wellbore inflow control valve 110*b* can include a second sensor 142*b* and a second controller 144*b* substantially similar to the first sensor 142*a* and the first controller 144*a* previously described.

The third wellbore inflow control device 110*c* includes the third control unit 134*c*, substantially similar to the first control unit 134*a* previously described. The third wellbore inflow control device 110*c* can include a third sensor 142*c* and a third controller 144*c* substantially similar to the first sensor 142*a* and the first controller 144*a* previously described.

Figure 3:
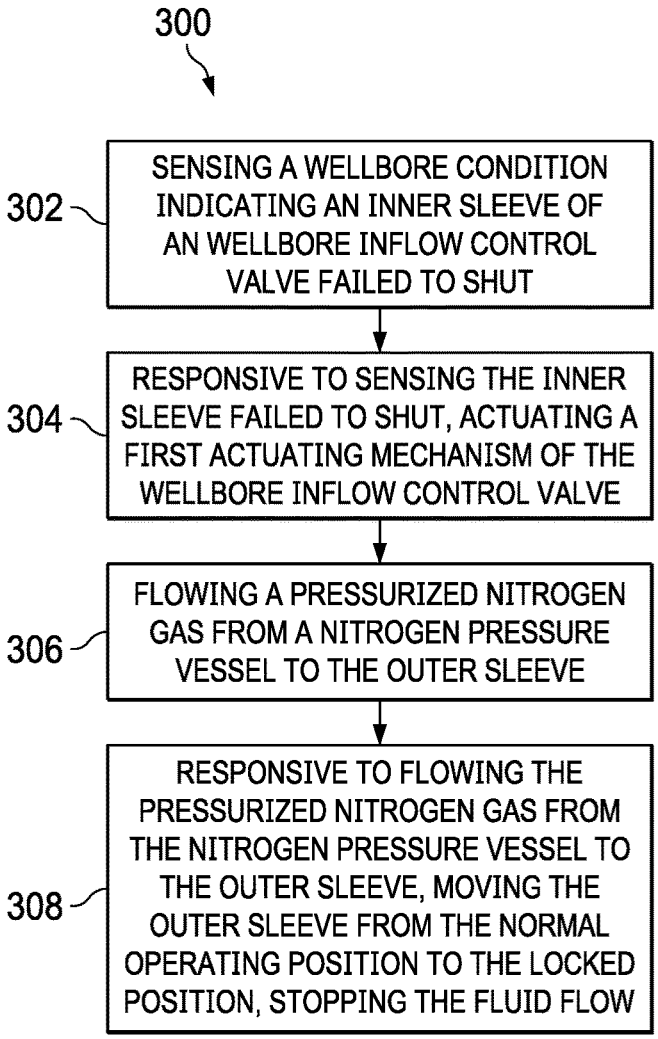
FIG. 3 is a flow chart of an example method of stopping a fluid flow from a stuck open inflow control device.

FIG. 3 is a flow chart of an example method 300 of stopping a fluid flow from a stuck open inflow control device. At 302, in a wellbore including a wellbore inflow control valve to control the fluid flow through the wellbore with a sensor and a controller, a wellbore condition is sensed. The wellbore inflow control valve includes an inflow control valve body, an inner sleeve, and outer sleeve, and a first actuation mechanism. The inflow control valve body includes an inlet. The inner sleeve is coupled to an inner surface of the inflow control valve body. The inner sleeve is movable from a closed position to an open position to provide a fluid flow path from an annulus of a wellbore through the inflow control valve body and moveable from the open position to the closed position to restrict the fluid flow through the inflow control valve body. The outer sleeve is coupled to an outer surface of the inflow control valve body to stop the fluid flow through the inlet. The outer sleeve is movable from a normal operating position offset from the inlet of the inflow control valve body to a locked position limiting fluid flow to the inlet of the inflow control valve to stop the fluid flow through the inflow control valve. The first actuation mechanism is coupled to the outer sleeve. The first actuation mechanism is operable to move the outer sleeve from the normal operating position offset from the inlet of the inflow control valve body to the locked position limiting fluid flow to the inlet of the inflow control valve body to stop the fluid flow through the inflow control valve body.

The sensor senses a wellbore condition of the wellbore and generate a signal representing the wellbore condition. The controller receives the signal representing the wellbore condition, and responsive to receiving the signal representing the wellbore condition, to operate the first actuation mechanism to move the outer sleeve from the normal operating position to the locked position to limit fluid flow through the inflow control valve.

Sensing the wellbore condition indicating the inner sleeve failed to shut can include generating a signal representing the wellbore condition indicating the inner sleeve failed to shut. The signal representing the wellbore condition indicating the inner sleeve failed to shut is transmitted to the controller by the sensor. The signal representing the wellbore condition indicating the inner sleeve failed to shut is received at the controller.

At 304, responsive to receiving the signal representing the wellbore condition indicating the inner sleeve failed to shut, by the controller, the first actuation mechanism is actuated.

At 306, when the first actuation mechanism includes a nitrogen pressure vessel, by the controller, a pressurized nitrogen gas is flowed from the nitrogen pressure vessel to the outer sleeve.

At 308, responsive to flowing the pressurized nitrogen gas from the nitrogen pressure vessel to the outer sleeve, the outer sleeve is moved from the normal operating position to the locked position, stopping the fluid flow. Where the wellbore inflow control valve includes a latch, the outer sleeve is latched in the locked position. Responsive to latching the outer sleeve in the locked position, the fluid flow is maintained stopped. The method can include unlatching the outer sleeve. The method can include releasing, by the controller, the pressurized nitrogen gas from the outer sleeve. The method can include responsive to releasing the pressurized nitrogen gas from the outer sleeve, moving the outer sleeve from the locked position to the normal operating position. The method can include responsive to moving the outer sleeve from the locked position to the normal operating position, allowing the fluid flow.

Figure 4:
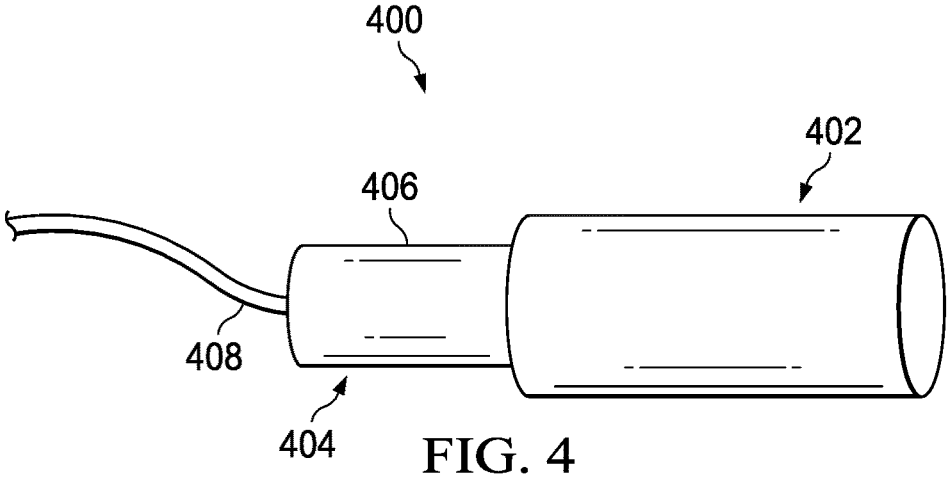
FIG. 4 is a schematic view of a stand-alone outer sleeve sealing assembly.

FIG. 4 is a schematic view of a stand-alone outer sleeve sealing assembly 400. The stand-alone outer sleeve sealing assembly can be positioned in a wellbore around a portion of an inflow control valve (not shown) to move to seal the inflow control valve when the inflow control valve is stuck open, allowing flow from the wellbore into the inflow control valve.

Referring to FIG. 4, the stand-alone outer sleeve sealing assembly 400 includes an outer sleeve assembly 402. The outer sleeve assembly 402 is in a normal operating position. When coupled to the inflow control valve, the outer sleeve assembly 402 is in the normal operating position allowing flow through an inlet of the inflow control valve. The outer sleeve assembly 402 can move to a locked position sealing the inlet of the inflow control valve to stop the fluid flow through the inflow control valve. The outer sleeve assembly 402 is a metal, for example, steel or aluminum.

As shown in FIG. 4, the stand-alone outer sleeve sealing assembly 400 includes an actuation mechanism 404 operably coupled to the outer sleeve assembly 402. The actuation mechanism 404 includes a pressure vessel 406. The pressure vessel 406 contains a pressurized gas, such as nitrogen, to provide a motive force to the outer sleeve assembly 402 the normal operating position to the locked position. The pressure vessel 406 can include a piston (not shown) to further force the pressurized nitrogen to move the outer sleeve assembly 402. Additionally or alternatively, the piston maintains the nitrogen pressurized within the pressure vessel 406. The piston, is actuated by a hydraulic fluid from a hydraulic supply conduit 408 coupled to the pressure vessel 406. The piston forces a sliding sleeve cap (not shown), substantially similar to the sliding sleeve cap described earlier, coupled to the outer sleeve assembly 402 to move the outer sleeve assembly 402 from the normal operating position to the locked position.

The sliding sleeve cap is movably coupled to a sliding element (not shown), substantially similar to the sliding element described earlier. The sliding element can coupled to the inflow control valve to align and move the outer sleeve assembly 402 to seal inflow control valve inlet.

The stand-alone outer sleeve sealing assembly 400 can include a latch mechanism (not shown) to lock the outer sleeve assembly 402 in its closed position. The latch mechanism is substantially similar to the latch mechanism described earlier.

While the disclosure includes a limited number of embodiments, those skilled in the art, having benefit of this disclosure, will appreciate that other embodiments can be devised which do not depart from the scope of the present disclosure. Accordingly, the scope should be limited only by the attached claims.

The invention claimed is:

1. A wellbore inflow control valve comprising:

an inflow control valve body comprising an inlet;

an inner sleeve coupled to an inner surface of the inflow control valve body, the inner sleeve movable from a closed position to an open position to provide a fluid flow path from an annulus of a wellbore through the inflow control valve body and moveable from the open position to the closed position to restrict a fluid flow along the fluid flow path through the inflow control valve body;

an outer sleeve coupled to an outer surface of the inflow control valve body to stop the fluid flow through the inlet, the outer sleeve movable from a normal operating position offset from the inlet of the inflow control valve body to a locked position limiting fluid flow to the inlet of the inflow control valve to stop the fluid flow through the inflow control valve;

a sliding sleeve cap coupled to the outer sleeve; and a first actuation mechanism coupled to the outer sleeve by the sliding sleeve cap, the first actuation mechanism configured to force the sliding sleeve cap to move the outer sleeve from the normal operating position offset from the inlet of the inflow control valve body to the locked position limiting fluid flow to the inlet of the inflow control valve body to stop the fluid flow through the inflow control valve body.

2. The wellbore inflow control valve of claim 1, wherein the first actuation mechanism comprises a nitrogen pressure vessel.

3. The wellbore inflow control valve of claim 1, further comprising a second actuation mechanism coupled to the inner sleeve, the second actuation mechanism operable to reversibly move the inner sleeve between the closed position and the open position to control fluid flow through the inflow control valve body.

4. The wellbore inflow control valve of claim 1, further comprising:

a sensor configured to sense a wellbore condition of the wellbore and generate a signal representing the wellbore condition; and a controller configured to receive the signal representing the wellbore condition, and responsive to receiving the signal representing the wellbore condition, to operate the first actuation mechanism to move the outer sleeve to the locked position to stop the fluid flow through the inflow control valve body.

5. The wellbore inflow control valve of claim 4, wherein the sensor comprises at least one of a pressure sensor, a conductivity sensor, or a flow rate sensor.

6. The wellbore inflow control valve of claim 1, wherein the inner sleeve is configured to slide relative to the inner surface of the inflow control valve body stopping a fluid flow through the inflow control valve.

7. The wellbore inflow control valve of claim 1, further comprising a latch to maintain the outer sleeve in the locked position.

8. A valve assembly comprising:

a sliding element comprising an outer sleeve configured to be positioned external to a valve body defining an inlet, the outer sleeve movable from a normal operating position offset from the inlet of the valve body to a locked position limiting fluid flow to the inlet of the valve body to stop the fluid flow through the valve body;

a sliding sleeve cap coupled to the outer sleeve; and a first actuation mechanism coupled to the outer sleeve by the sliding sleeve cap, the first actuation mechanism configured to force the sliding sleeve cap to move the outer sleeve from the normal operating position offset from the inlet of the valve body to the locked position limiting fluid flow to the inlet of the valve body to stop the fluid flow through the valve body.

9. The valve assembly of claim 8, wherein the first actuation mechanism comprises a nitrogen pressure vessel.

10. The valve assembly of claim 8, further comprising:

a sensor configured to sense a condition and generate a signal representing the condition; and a controller configured to receive the signal representing the condition, and responsive to receiving the signal representing the condition, to position the first actuation mechanism to position the outer sleeve to stop the fluid flow through the valve body.

11. The valve assembly of claim 10, wherein the sensor comprises at least one of a pressure sensor, a conductivity sensor, a flow rate sensor, or a valve position sensor.

12. The valve assembly of claim 8, further comprising an inner sleeve coupled to an inner surface of the valve body, the inner sleeve movable from a closed position to an open position to provide a fluid flow path through the valve body and moveable from the open position to the closed position to restrict the fluid flow path through the valve body.

13. The valve assembly of claim 12, further comprising a second actuation mechanism coupled to the inner sleeve, the second actuation mechanism operable to reversibly move the inner sleeve between the closed position and the open position to control fluid flow through the valve body.

14. The valve assembly of claim 8, wherein the sliding element further comprises a latch to maintain the outer sleeve in the locked position.

15. A method of stopping a fluid flow of a wellbore, the wellbore comprising a wellbore inflow control valve to control the fluid flow through the wellbore, the wellbore inflow control valve comprising:

an inflow control valve body comprising an inlet;

an inner sleeve coupled to an inner surface of the inflow control valve body, the inner sleeve movable from a closed position to an open position to provide a fluid flow path from an annulus of a wellbore through the inflow control valve body and moveable from the open position to the closed position to restrict the fluid flow through the inflow control valve body;

an outer sleeve coupled to an outer surface of the inflow control valve body to stop the fluid flow through the inlet, the outer sleeve movable from a normal operating position offset from the inlet of the inflow control valve body to a locked position limiting fluid flow to the inlet of the inflow control valve to stop the fluid flow through the inflow control valve;

a sliding sleeve cap coupled to the outer sleeve; and a first actuation mechanism coupled to the outer sleeve by the sliding sleeve cap, the first actuation mechanism configured to force the sliding sleeve cap to move the outer sleeve from the normal operating position offset from the inlet of the inflow control valve body to the locked position limiting fluid flow to the inlet of the inflow control valve body to stop the fluid flow through the inflow control valve body;

the method comprising:

actuating the first actuation mechanism;

responsive to actuating the first actuation mechanism, forcing the sliding sleeve cap to move;

responsive to moving the sliding sleeve cap, moving the outer sleeve from the normal operating position to the locked position; and responsive to moving the outer sleeve from the normal operating position to the locked position, stopping the fluid flow.

16. The method of claim 15, wherein the wellbore inflow control valve further comprises:

a sensor configured to sense a wellbore condition of the wellbore and generate a signal representing the wellbore condition; and a controller configured to receive the signal representing the wellbore condition, and responsive to receiving the signal representing the wellbore condition, to operate the first actuation mechanism to move the outer sleeve from the normal operating position to the locked position to limit fluid flow through the inflow control valve; the method further comprising:

sensing the wellbore condition, wherein the wellbore condition indicates the inner sleeve failed to shut, allowing fluid flow through the inlet;

generating a signal representing the wellbore condition indicating the inner sleeve failed to shut;

transmitting the signal representing the wellbore condition indicating the inner sleeve failed to shut to the controller;

receiving the signal representing the wellbore condition indicating the inner sleeve failed to shut at the controller; and responsive to receiving the signal representing the wellbore condition indicating the inner sleeve failed to shut, by the controller, actuating the first actuation mechanism.

17. The method of claim 15, wherein the first actuation mechanism comprises a nitrogen pressure vessel, the method further comprises:

by the controller, flowing a pressurized nitrogen gas from the nitrogen pressure vessel to the sliding sleeve cap; and responsive to flowing the pressurized nitrogen gas from the nitrogen pressure vessel to the sliding sleeve cap, moving the outer sleeve from the normal operating position to the locked position, stopping the fluid flow.

18. The method of claim 14, wherein the wellbore inflow control valve further comprises a latch, the method further comprises:

latching the outer sleeve in the locked position; and responsive to latching the outer sleeve in the locked position, maintaining the fluid flow stopped.

19. The method of claim 18, further comprising:

unlatching the outer sleeve;

releasing, by the controller, the pressurized nitrogen gas from the sliding sleeve cap;

responsive to releasing the pressurized nitrogen gas from the sliding sleeve cap, moving the outer sleeve from the locked position to the normal operating position; and responsive to moving the outer sleeve from the locked position to the normal operating position, allowing the fluid flow.

* * * * *